US007116058B2

(12) United States Patent
Lo et al.

(10) Patent No.: US 7,116,058 B2
(45) Date of Patent: Oct. 3, 2006

(54) METHOD OF IMPROVING THE STABILITY OF ACTIVE MATRIX OLED DISPLAYS DRIVEN BY AMORPHOUS SILICON THIN-FILM TRANSISTORS

(75) Inventors: Shin-Tai Lo, Miaoli (TW); Ching-Fu Hsu, Fongyuan (TW)

(73) Assignee: Wintek Corporation, Taichung (TW)

( * ) Notice: Subject to any disclaimer, the term of this patent is extended or adjusted under 35 U.S.C. 154(b) by 0 days.

(21) Appl. No.: 10/998,550

(22) Filed: Nov. 30, 2004

(65) Prior Publication Data

US 2006/0113918 A1 Jun. 1, 2006

(51) Int. Cl.
*G09G 3/10* (2006.01)

(52) U.S. Cl. ..... 315/169.1; 315/169.3; 345/204; 345/212; 345/82; 345/92

(58) Field of Classification Search .. 315/169.1–169.3; 345/39, 42, 82, 44–46, 54, 48, 78, 79, 92, 345/96, 99, 204, 211, 214
See application file for complete search history.

(56) References Cited

U.S. PATENT DOCUMENTS 6,229,508 B1 * 5/2001 Kane ..... 345/82
6,501,466 B1 * 12/2002 Yamagishi et al. ..... 345/204
6,677,713 B1 1/2004 Sung
6,909,242 B1 * 6/2005 Kimura ..... 315/169.3
6,950,081 B1 * 9/2005 Akimoto et al. ..... 345/55

* cited by examiner

*Primary Examiner*—Haissa Philogene
(74) *Attorney, Agent, or Firm*—Birch, Stewart, Kolasch & Birch, LLP

(57) ABSTRACT

A method of improving the stability of organic light emitting diode (OLED) display devices driven by amorphous silicon thin-film transistors, in which the driving circuitry within each sub-pixel includes a driving transistor for driving organic light emitting diode (OLED), a scanning transistor and a storage capacitance. An end of the capacitance is connected to the signal resetting line, which a resetting time pulse of high potential and low potential are supplied. Since the resetting signals within the sub-pixels are synchronized, a single voltage of the resetting signal can control the positive and negative stresses for each transistor in the sub-pixels on the panel.

3 Claims, 11 Drawing Sheets

METHOD OF IMPROVING THE STABILITY OF ACTIVE MATRIX OLED DISPLAYS DRIVEN BY AMORPHOUS SILICON THIN-FILM TRANSISTORS

FILED OF THE INVENTION

The present invention is about driving an amorphous silicon thin-film transistor, more particularly driving an organic light emitting diode (OLED) display, to enhance the stability of the threshold voltage (Vth) as a function of time on the amorphous silicon thin-film transistors.

BACKGROUND OF THE INVENTION

There are two ways to drive an organic light emitting display (OLED): one is passive matrix driving and the other is active matrix driving. In an active matrix device, a good service life and high resolution can be achieved without being driven to an extremely high brightness. Therefore, OLED combined with thin-film transistor (TFT) to realize the active matrix technology conforms to the present market requirements for fluidity of images as well as higher and higher resolution in display panels that fully demonstrate the superior properties of OLED. As a result of the continuous improvements in light emitting efficiency on OLED materials, using amorphous silicon thin-film transistor (a-Si TFT) as the driving platform for OLED devices is no longer infeasible. As a result of the maturity of manufacturing processes and equipments in a-Si TFT, a lower manufacturing cost can be achieved which greatly lower the over-all cost of the active matrix OLED.

Although a-Si TFT has absolute advantage of lower cost, there are still technical issues needed to improve if a-Si TFT is to be used to drive OLED. Two major goals must be achieved. The first goal is to improve the stability of the a-Si TFT device, and the second is to increase the driving capability of current in the a-Si TFT device.

FIG. 1 is a schematic representation of the driving circuitry for each sub-pixels in a traditional display device. Each sub-pixel has a 2T1C (two TFTs and one capacitance) circuitry structure. All the TFTs used are N-Channel a-Si TFT. The drain (D) of transistor 12 is connected to the power source Vdd, and its source (S) is connected to the anode of OLED 14. The cathode of OLED 14 is connected to a comparatively fixed low potential Vss (for example to the ground as zero potential). Also, the gate (G) of transistor 11 is connected to scan line 17, the source (S) of transistor 11 is connected to data line 16, and the drain (D) of transistor 11 is connected to the gate (G) of transistor 12 and one end of capacitance 13. The other end of the capacitance 13 is connected to a fixed reference potential Vref.

The fundamental working principle is as follows: Through controlling the signal of scan line 17 to trigger transistor 11 ON, which then input the voltage signal representing gray scale data of image into storage capacitance 13 to control the gate of transistor 12. The current is flowing through the transistor 12, which can be varied by changing the gate voltage Vgs, of transistor 12. Naturally, in order to make transistor 12 produce a driving current, the Vgs value in transistor 12 must be greater than its threshold voltage Vth.

Conventional scanning structure employs a continuous scanning mode, beginning with the first line on the (n)th-frame, and consecutively scan to the last line of the frame, immediately followed by the first line on the (n+1)th-frame, and consecutively scan to the last line of the (n+1)th frame, as shown in FIG. 2.

The conventional scan mode stated above, when applied to OLED structures driven by a-Si TFT, will produce a continuous positive Vgs voltage on transistor 12. A continuous positive Vgs bias, called Positive Stress, it will rapidly degrade the a-Si TFT devices on transistor 12. Also, the threshold voltage, Vth, on transistor 12 will increase with time instead of maintaining at the original level which will incur a "Positive Shift" as shown in FIG. 3. Therefore long term stability of a-Si TFT driving devices on transistor 12 can not be achieved if conventional a-Si TFT driving circuitry is employed.

Therefore, the positive shift as a result of instability in threshold voltage, Vth, brings about two problems: The first is that the original brightness of OLED can not be maintained as a result of the decrease in output current on transistor 12, with time. The second problem is that the degree of degradation on transistor 12 in the sub-pixel varies with time. Because the difference in positive stress on transistor 12 of each sub-pixel will bring about a difference in brightness on the sub-pixel of the display panel, resulting in so called "Temporal Non-Uniformity".

To solve the weaknesses mentioned above, the U.S. Pat. No. 6,677,713 "Driving Circuit and Method for Light Emitting Device" proposed 3T1C driving circuitry as shown in FIG. 4. The driving circuitry of the pixel includes a driving transistor 22 with the gate (G) connected to node B, a light emitting device 24 connected in serial to the driving transistor forming a light emitting path. The light emitting path is then attached between the system high voltage, Vdd, and system low voltage, Vss. When driving transistor 22 is turned on, the system high voltage, Vdd, triggers the light emitting device 24 and emits light. A capacitance 23 connected to node B, is used to maintain the On or Off position of driving transistor 22. Also, a driving circuit consists of a primary transistor 21 and a secondary transistor 25 is connected in parallel to node B. The gate (G) of primary transistor 21 receives a time pulse, S1, of primary scan line 27, and gate (G) of secondary transistor 25 receives a time pulse, S2, of secondary scan line 28. The primary scan pulse S1 and the secondary scanning pulse S2 have the same frequency, but there is a time delay in the secondary scan pulse S2 compared with the primary scan pulse S1.

Therefore the working principle is that when even number of continuous primary scanning pulse S1 trigger transistor 21 On, allows the data voltage in data line 26 corresponding to a frame of image to input to node B, toggles the driving transistor 22 On, And proceeds a time-interval, $T_{ON}$, of image display; when even number of continuous secondary scanning pulse S2 triggers transistor 25 On, allows a closure voltage Vref2 into node. B, and toggles transistor 22 Off, and proceeds a time-interval $T_{OFF}$ of image off. The relationship between scan line and time in driving structure of the image frame is shown in FIG. 5.

The U.S. Pat. No. 6,677,713, as compared to the conventional technology, uses an amorphous silicon secondary transistor 25 to recover the threshold voltage Vth of driving transistor 22 to its initial value, and prevents Vth from increasing beyond its original value, and from the degradation of driving transistor 22 with time, so the problem of difference in brightness of each sub-pixel on the display panel can be resolved.

However in the patent, an amorphous silicon transistor and a secondary scan line 28 have to be added to each sub-pixel to process settings of the negative driving bias. In other words, a set of scan driver need to be added to the system which will increase the complexity in manufacturing and, with the additional driving circuitry, substantially increase its cost.

SUMMARY OF THE INVENTION

Therefore this invention proposes an innovated way to improve the stability of a driving device for organic electric-excited light emitting transistor driven by amorphous silicon thin film transistor, the main purpose is to eliminate the non-uniformity of the threshold voltage Vth on thin film transistor, and extend life of the active matrix display panels.

Another purpose is to achieve the same result as in U.S. Pat. No. 6,677,713 without additional transistors or scan lines. That is, this invention involves a simpler system, which implies a lower cost for the manufacturers employing it.

To achieve the objectives mentioned above, this invention propose a driving scheme, the circuitry of which involves a driving transistor with its drain connected to power supply Vdd, its source connected to the anode of a light emitting diode. The cathode of light emitting diode is then connected to a comparatively fixed low potential Vss. A scan transistor, with its gate connected to the scan line, its source connected to data line and the drain connected to the gate of a driving transistor and an end of a storage capacitance. The other end of the storage capacitance is connected to a resetting signal line, which provides a resetting signal Vcom of high potential V1 and low potential V2 time pulses.

According to the resetting signal Vcom time pulse a low potential V2 input to the storage capacitance toggles the gate of transistor to negative potential and temporarily prevent the organic light emitting diode (OLED) from emitting light, whereas a high potential V1 input to the storage capacitance toggles the gate of transistor to positive potential and trigger the organic light emitting diode (OLED) to emit light. That is, the positive or negative bias driven by driving transistor in each sub-pixel on display panel can be controlled through a single resetting signal voltage Vcom.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
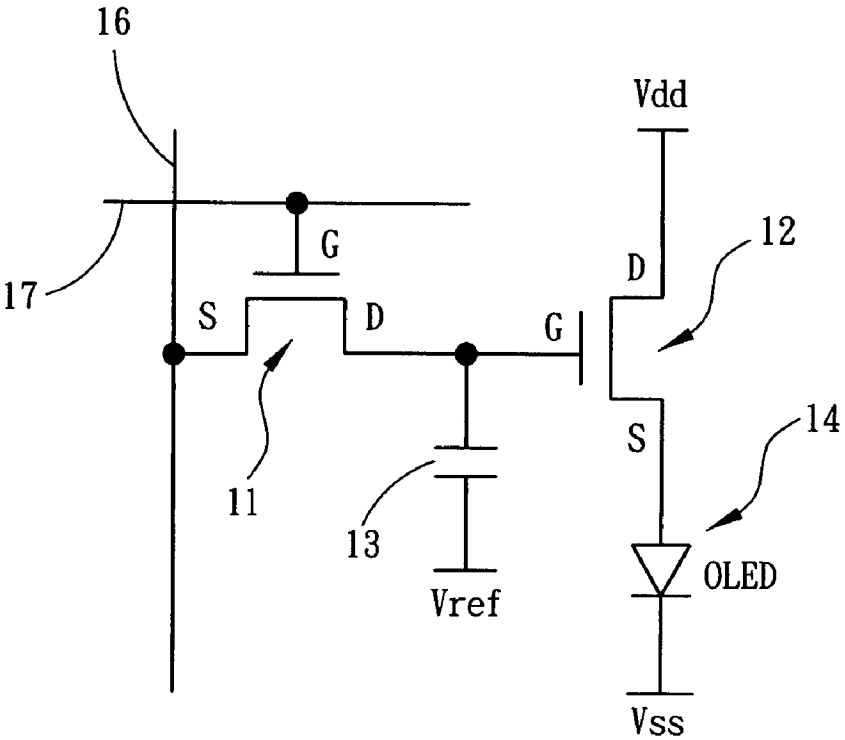
Fig. 1 PRIOR ART
FIG. 1 is a schematic diagram of driving circuitry in a sub-pixel on conventional display device.
Figure 2:
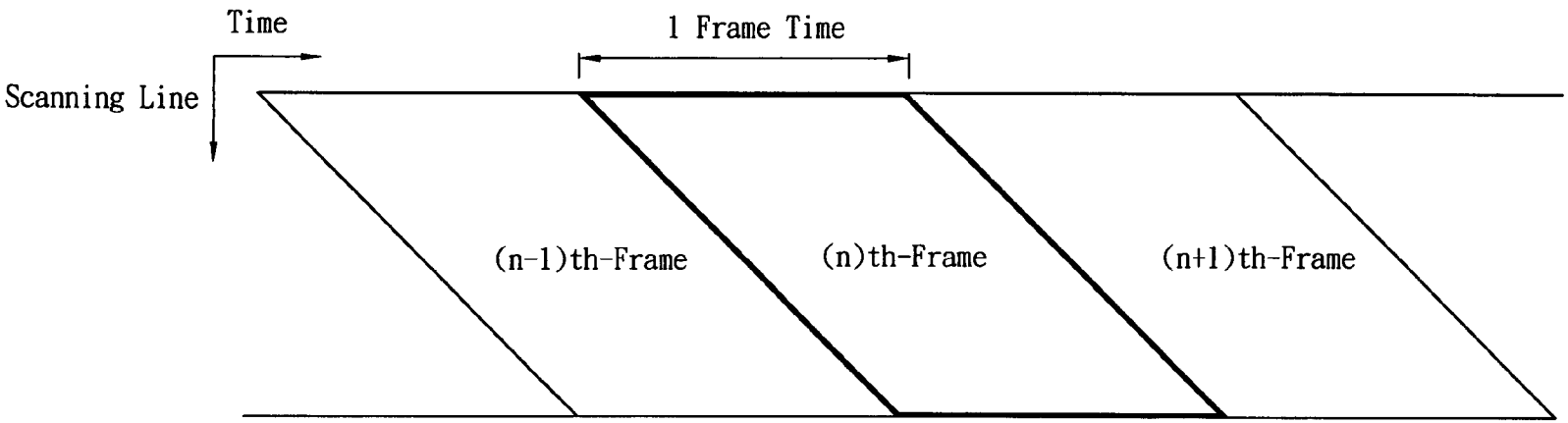
Fig. 2 PRIOR ART
FIG. 2 is a schematic diagram of the relationship between scan lines and time for the driving structure of each frame of image on conventional display devices.
Figure 3:
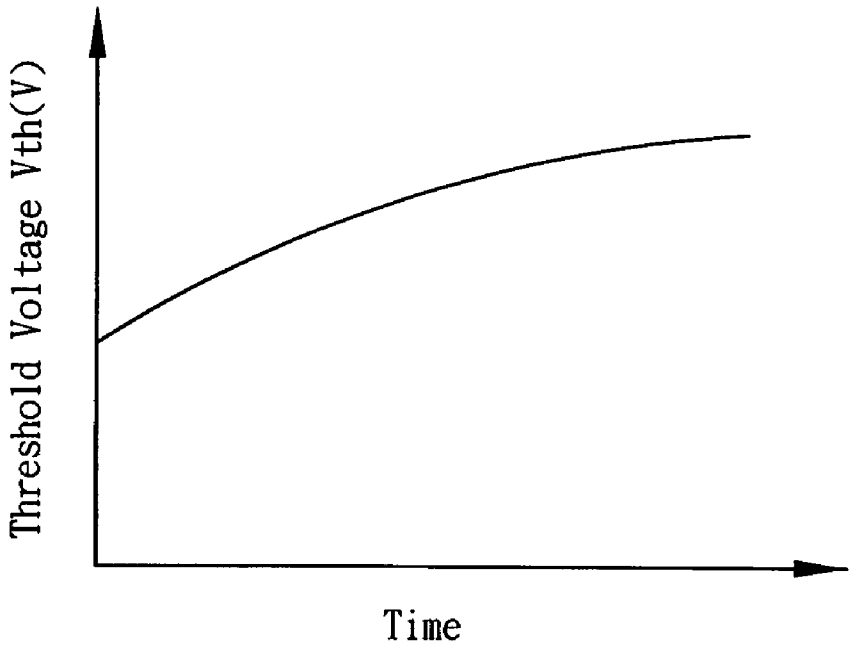
Fig. 3 PRIOR ART
FIG. 3 is a diagram showing the variation of threshold voltage with operation time for driving transistors on traditional display devices.
Figure 4:
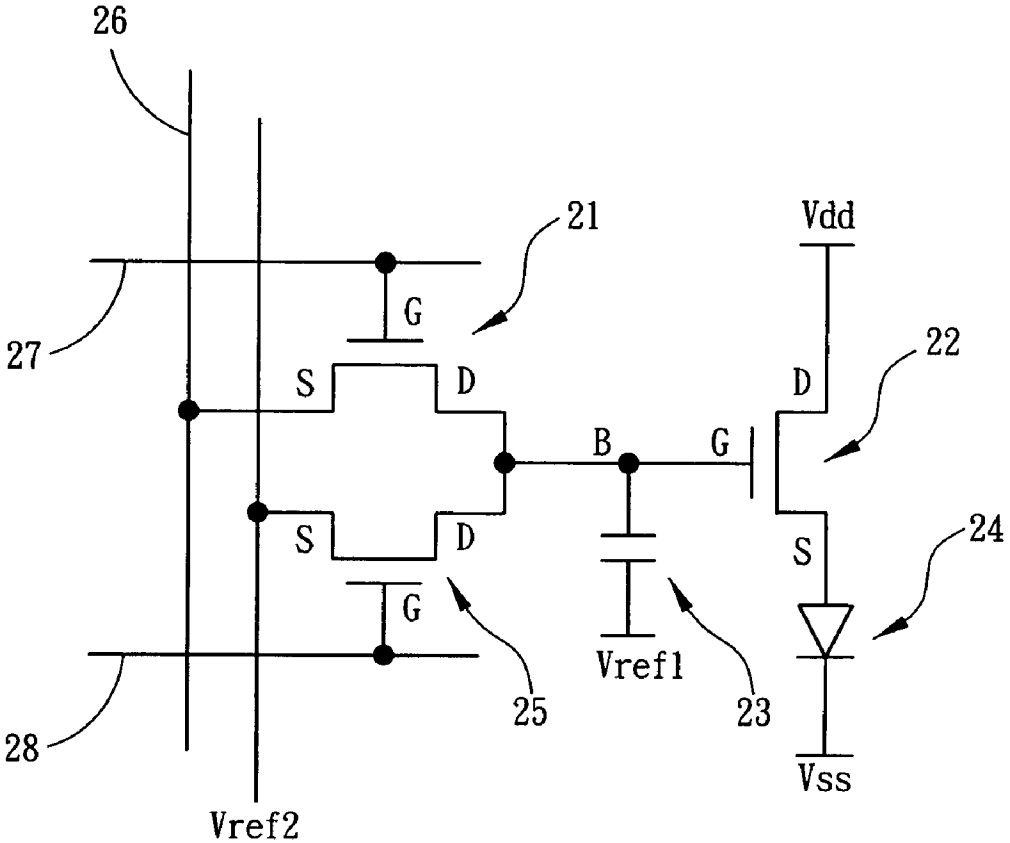
Fig. 4 PRIOR ART
FIG. 4 is a schematic diagram of the driving circuitry in each sub-pixel on U.S. Pat. No. 6,677,713.
Figure 5:
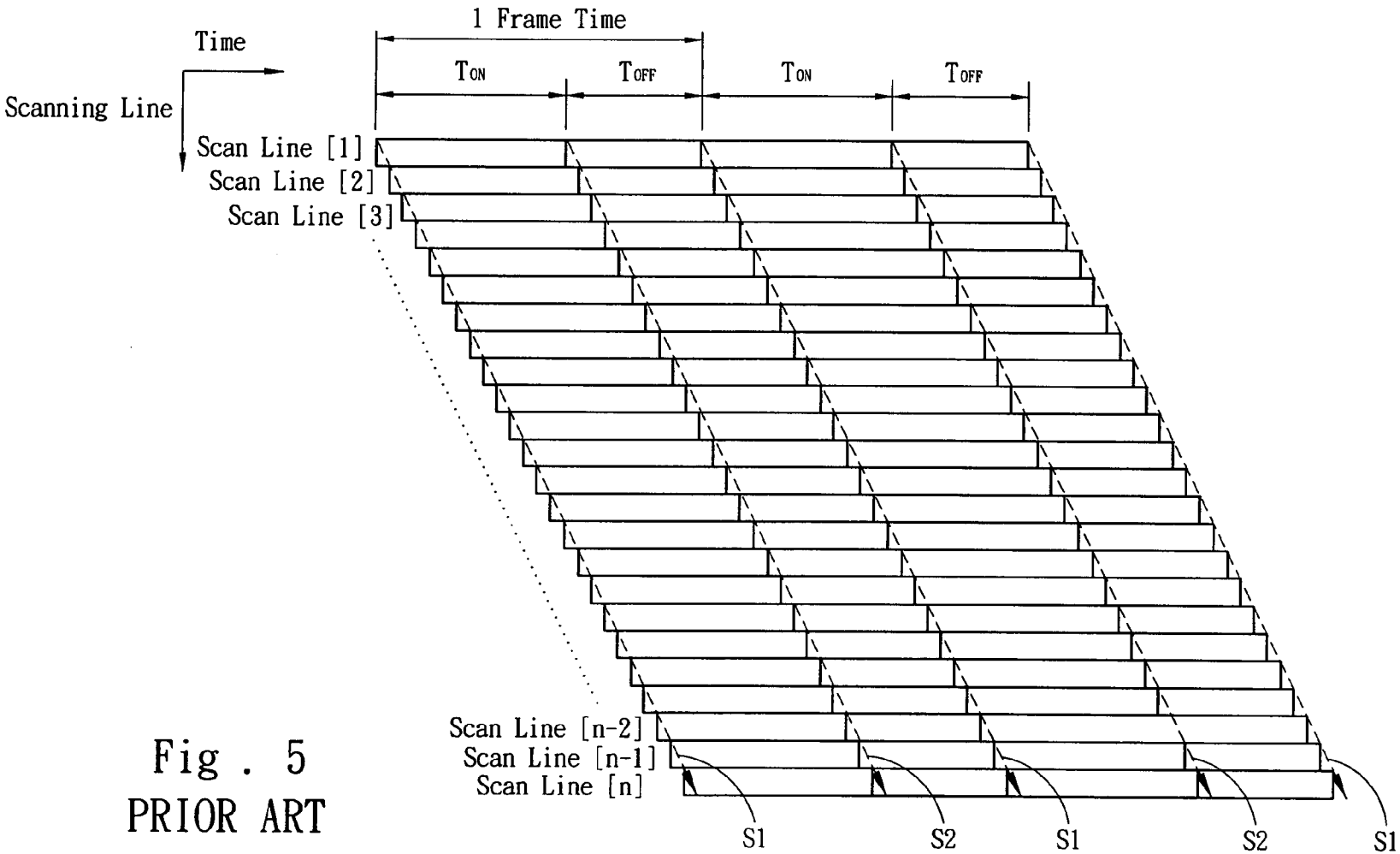
Fig. 5 PRIOR ART
FIG. 5 is a schematic diagram showing the relationship between scan lines and time for the driving structure.
Figure 6:
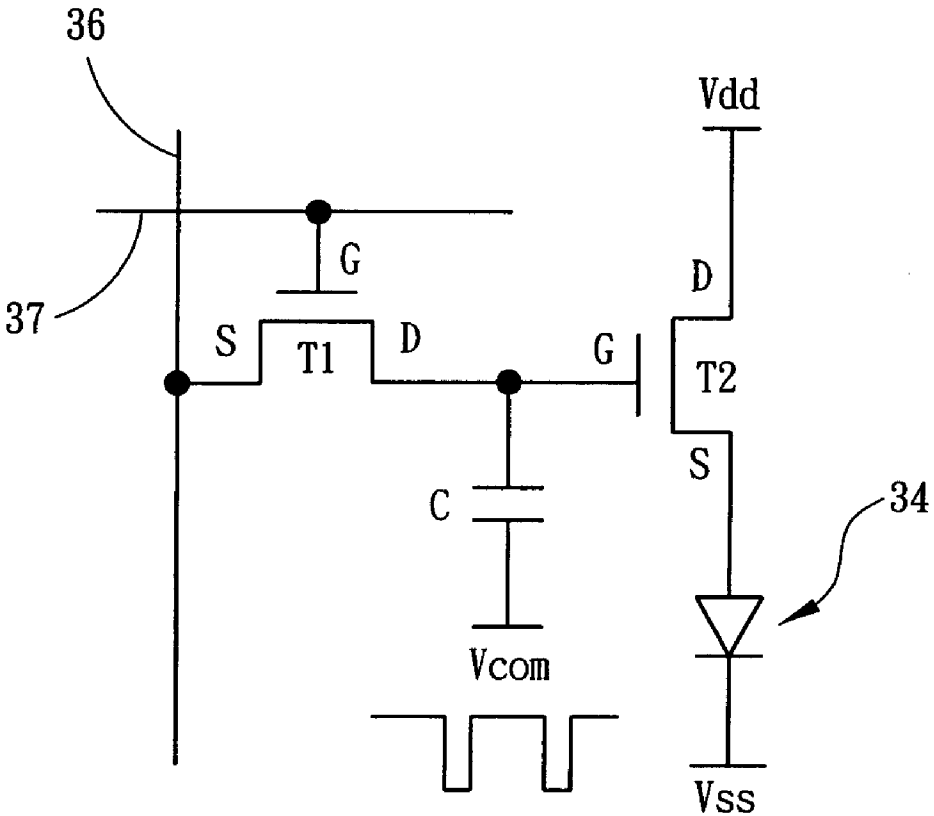
FIG. 6 is a schematic diagram of driving circuitry in a sub-pixel on this invention.
Figure 7:
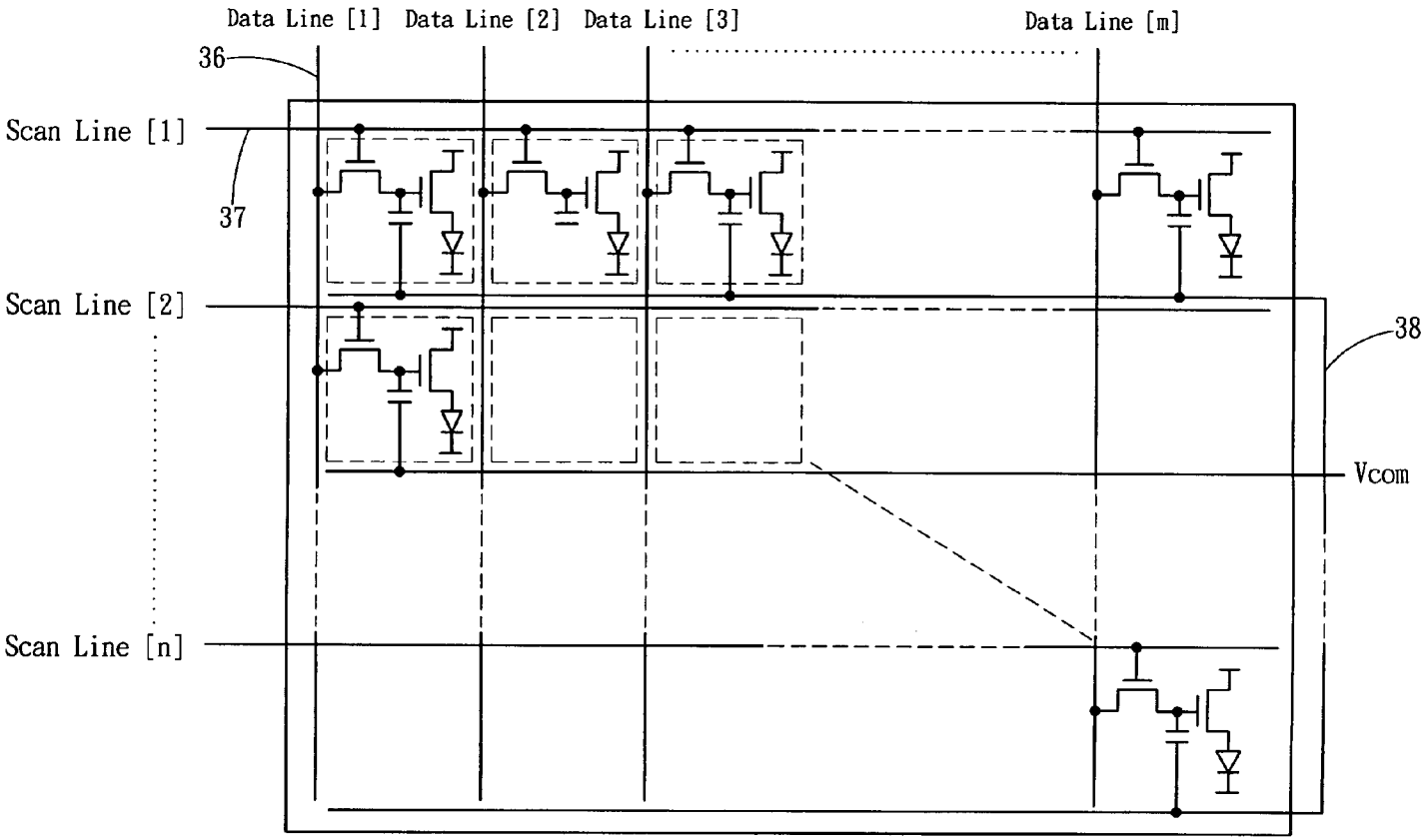
FIG. 7 is a schematic diagram of the connection and control of each sub-pixel on display panel of this invention.

The driving circuitry for each sub-pixel in this invention and the schematic diagram of the connection as well as control of each sub-pixel on display panel are shown in FIGS. 6 and 7. As shown in the figures, each data line 36 and each scan line 37 on the display device form a matrix of m×n sub-pixels on the display panel. The driving circuitry for each sub-pixel includes two TFT and a capacitance. The organic light emitting diode (OLED) 34 is driven by a driving transistor T2, the drain (D) of which is connected to the power source Vdd, and the source (S) to the anode of the organic light emitting diode 34. The cathode of the organic light emitting diode 34 is connected to a comparatively fixed low potential Vss (for example to the ground as zero potential). Besides, the gate (G) of a scanning transistor is connected to scan line 37, the source (S) is connected to data line 36, and the drain (D) to the gate (G) of driving transistor T2 and one end of storage capacitance. In contrast to the conventional design, the other end of the storage capacitance C in each sub-pixel on the panel is connected to a resetting signal line 38, which provides a resetting signal Vcom, synchronized with the resetting signal Vcom in every other sub-pixel on the panel.

Figure 8:
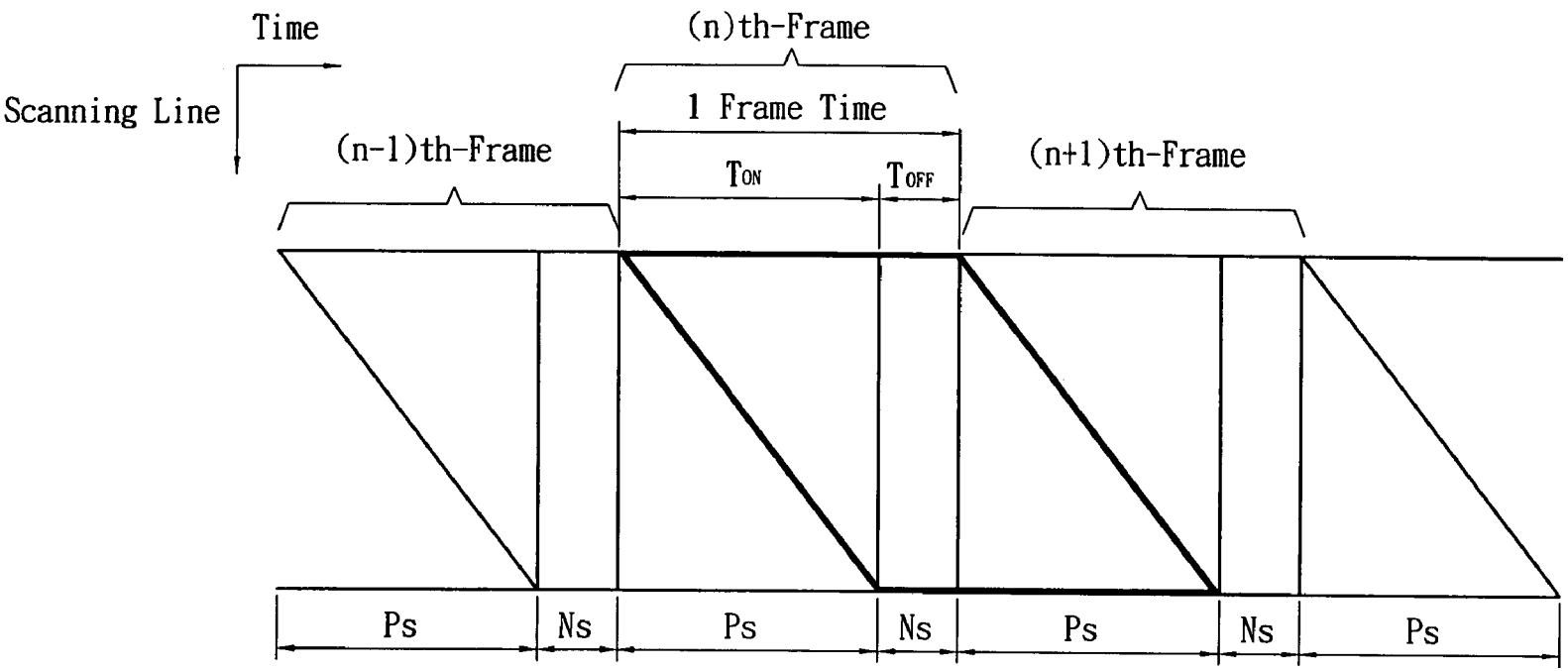
FIG. 8 is a schematic diagram of the driving structure for this invention.
Figure 9:
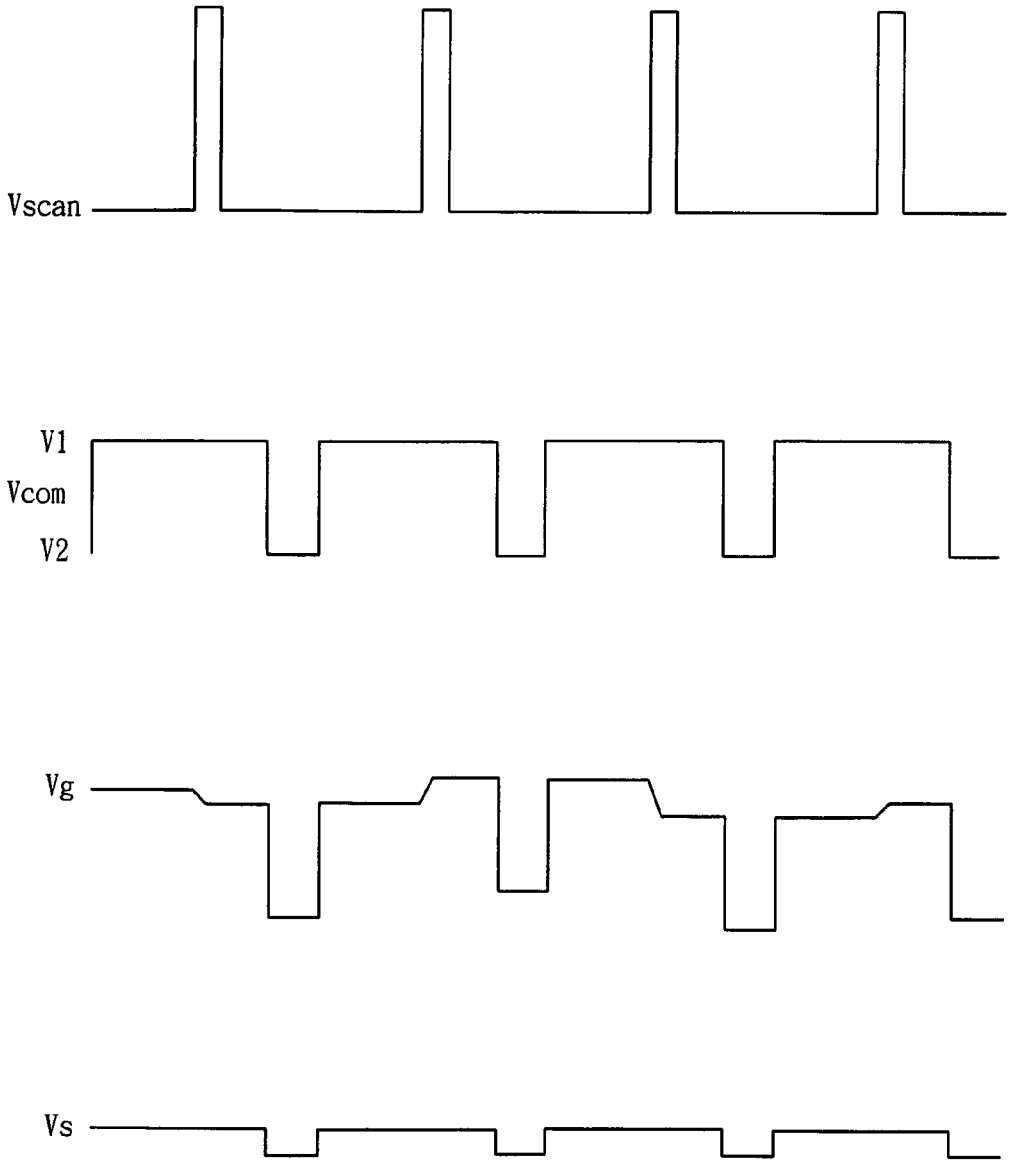
FIG. 9 is a schematic diagram of the time sequence of control signal corresponding to FIG. 8.

The driving structure of this invention and the corresponding time sequence of control signal are shown in FIGS. 8 and 9 where the scan operation begins with the first line of the Nth-frame, and proceeds consecutively to the last line of the frame. During this period of display time $T_{ON}$, the resetting signal is maintained at high potential V1. After finish scanning the last line of the frame, the resetting signal is lowered to potential V2, and maintains on that level during closure time $T_{OFF}$. The resetting signal is then increased to high potential level V1, before starting to scan the first line of the (n+1)th-frame. The remaining frames are operated with the same driving principle.

When the resetting signal Vcom is at high potential level V1, the scanning signal Vscan on scan line 37 will trigger scanning transistor T1, and send the data signal Vdata representing gray scale data on data line 36, into an end of storage capacitance C. This can be used to control the gate (G) of driving transistor T2, which incurs different Vgs voltages at different gate voltages Vg, and produces different driving current. Now the Vgs potential on driving transistor T2 is positive (Vg is greater than Vs), which implies all transistors T2 in sub-pixels on the display panel are at positive stress (Ps).

Figure 10:
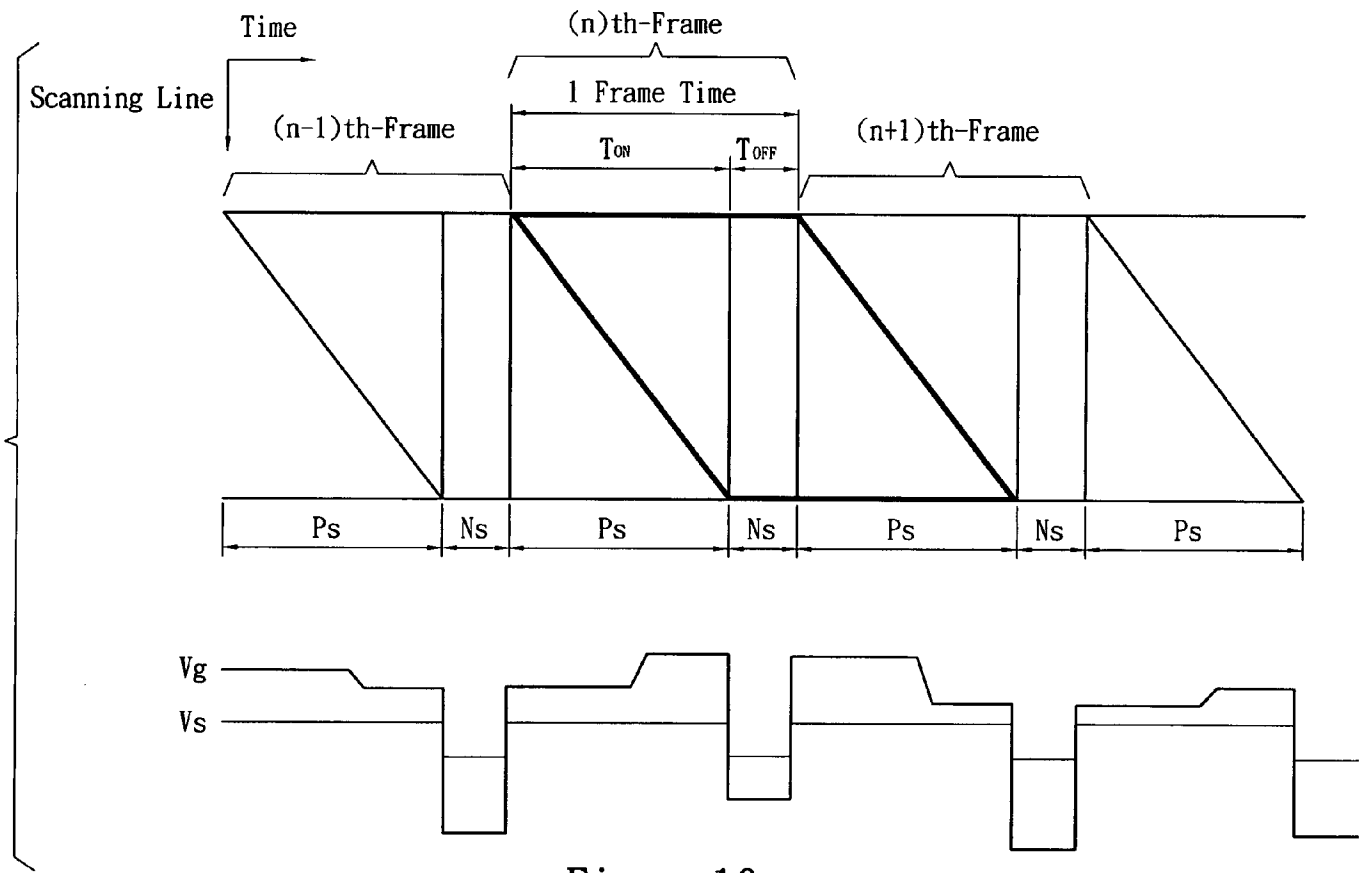
FIG. 10 is a diagram showing the variation of the control signals, Vg, in FIG. 8 and FIG. 9 with Vs.

When the resetting signal Vcom at high potential V1 is decreased to the low potential V2, the gate voltage Vg on transistor T2 will drop from Vdata to [Vdata−(V1−V2)], decreased by a level of (V1−V2), since the storage capacitance maintains the potential difference across both ends. Through proper choice of V1 and V2 voltages (for example a V1 of 20 volts and a V2 of −10 volts), the gate voltage Vg on transistor T2 becomes negative, therefore no current is output to the organic light emitting diode 34, and the source voltage Vs of driving transistor T2 will be at closure voltage, Voled/off, of the organic light emitting diode 34 (if Vss is zero). At the same time, Vgs value on transistor T2 will be a negative value [Vdata−(V1−V2)−Voled/off] (Vg is lower than Vs, as shown in FIG. 10), which implies all transistors T2 in the sub-pixels on the display panel are at negative stress (Ns).

Figure 11:
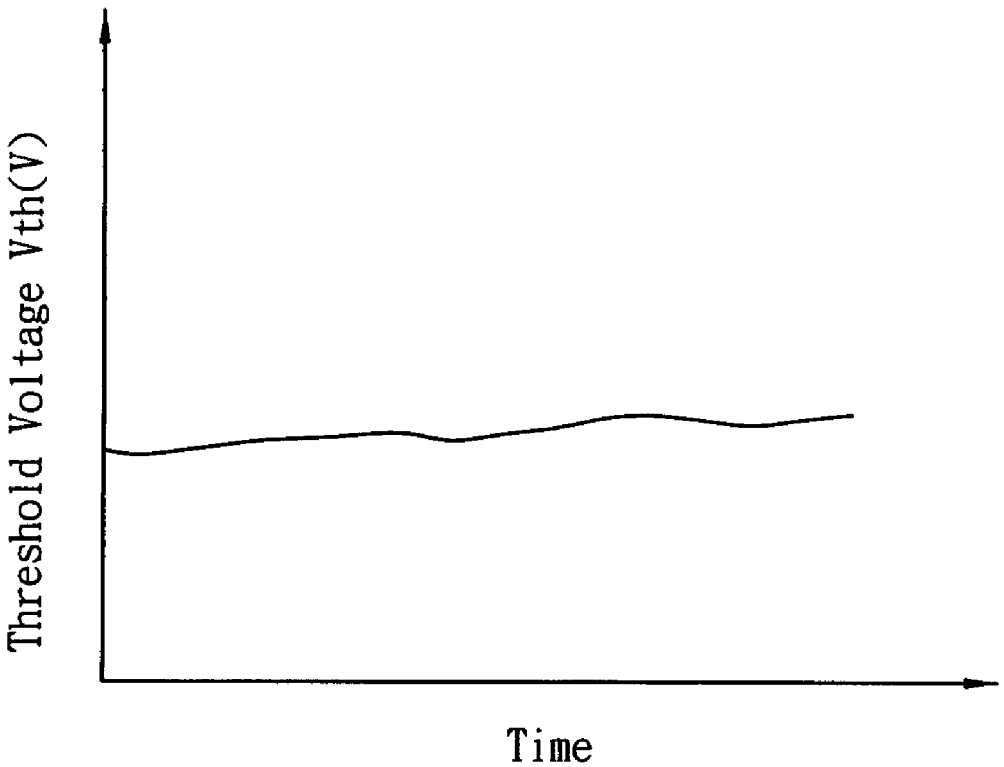
FIG. 11 is a diagram showing the variation of the threshold voltage Vth of the driving transistor with time.

As compared with the traditional driving scheme in which Vgs voltage in driving transistor 12 is constantly maintained at positive stress and produce a phenomenon called "positive shift". In this invention, the Vgs voltage in driving transistor T2 is under alternating positive and negative stresses which lowers the degradation rate of a-Si TFT devices, inhibits positive shift as a result of critical potential Vth on driving transistor, and increases the stability of a-Si TFT device as shown in FIG. 11.

In summary, the improvement of driving structure to enhance the stability of organic electric-excited light emitting display device driven by amorphous silicon thin film transistor has the following advantages:

1. Through alternating positive and negative stresses, a lower degradation rate of a-Si TFT device, and higher stability of organic electric-excited light emitting display device driven by amorphous silicon thin film transistor can be achieved.
2. Improving the stability of organic electric-excited light emitting display device driven by amorphous silicon thin film transistor will extend the life of active matrix display panel.
3. Without any increase in the number of transistors or scan lines, this invention is as simple to manufacture as the conventional scheme, whereas offers the same effect as in the U.S. Pat. No. 6,677,713.

Therefore the difference in driving structure between present invention and the U.S. Pat. No. 6,677,713 is that in this proposed technology, after the data of each scan line in the (n)th image frame on the panel is written, each scan line holds a different period of time before entering negative stress, hence the driving transistors of each sub-pixel on the display device are negative stressed at the same time. However in the U.S. Pat. No. 6,677,713, after the data of each scan line in the Nth image frame on the panel is written, each scan line holds the same period of time before entering negative stress, hence the driving transistors of each sub-pixel on the display device are negatively stressed consecutively rather than simultaneously.

Although there is a difference in driving structure, both technologies provide the same effect to the vision, and both utilize the phenomenon of persistence of vision. The eye will not perceive the flickering of an image with frequency higher than 60 Hz. This invention shares the same objectives and effects the U.S. Pat. No. 6,677,713 provides, but with a decreased complexity of system and lower cost for driving circuitry.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of improving the stability of an organic light emitting display device driven by an amorphous silicon thin film transistor, driving circuitry for driving the organic light-emitting display device including a driving transistor with a drain connected to a first power source, a source connected to an anode of an organic light emitting diode, a scan transistor having a gate connected to a scan line, a source connected to a data line and a drain connected to the gate of the driving transistor and one end of a storage capacitance, another end of the storage capacitance being connected to a resetting signal line, the method comprising the steps of:

driving each sub-pixel in active matrix organic light emitting diode display devices;

providing said driving circuitry for said driving;

connecting a cathode of the organic light emitting diode to a comparatively fixed low potential;

providing said scan transistor having a gate connected to scan line;

connecting the other end of the storage capacitance to a resetting signal line, to provide a time pulse for resetting signal Vcom of high potential V1 and low potential V2;

toggling the gate of the driving transistor to a negative voltage by the lower output voltage V2 at the storage capacitance in accordance with the time pulse of the applied resetting signal Vcom, which temporarily prevents the organic light emitting diode from emitting light.

2. The method according to claim 1, wherein the high potential V1 at the storage capacitance from the time pulse of resetting signal Vcom toggles the gate of the driving transistor to a positive voltage, which renders the organic light emitting diode to emit light.

3. The method according to claim 1, wherein the resetting signal Vcom is synchronized for each sub-pixel on the display device.

* * * * *